US012326048B2

(12) United States Patent
Keast

(10) Patent No.: US 12,326,048 B2
(45) **Date of Patent: *Jun. 10, 2025**

(54) LATCH ASSEMBLY FOR TORQUE MANAGEMENT

(71) Applicant: Larry G. Keast, Houston, TX (US)

(72) Inventor: Larry G. Keast, Houston, TX (US)

(73) Assignee: Larry G. Keast, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/399,034

(22) Filed: Dec. 28, 2023

(65) Prior Publication Data

US 2024/0125188 A1 Apr. 18, 2024

Related U.S. Application Data

(63) Continuation of application No. 17/973,635, filed on Oct. 26, 2022, now Pat. No. 11,905,770.

(60) Provisional application No. 63/310,184, filed on Feb. 15, 2022, provisional application No. 63/272,051, filed on Oct. 26, 2021.

(51) Int. Cl.
*E21B 19/16* (2006.01)
*E21B 19/00* (2006.01)

(52) U.S. Cl.
CPC ..... *E21B 19/161* (2013.01); *E21B 19/00* (2013.01); *E21B 19/168* (2013.01)

(58) Field of Classification Search
CPC ..... E21B 19/161; E21B 19/00; E21B 19/168; E21B 3/022
See application file for complete search history.

(56) References Cited

U.S. PATENT DOCUMENTS

| | | | | |
|---|---|---|---|---|
| 3,191,450 | A * | 6/1965 | Hart | E21B 3/022 474/146 |
| 4,269,395 | A | 5/1981 | Newman et al. | |
| 5,107,940 | A | 4/1992 | Berry | |
| 5,388,651 | A | 2/1995 | Berry | |
| 7,819,207 | B2 | 10/2010 | Cowan | |
| 10,648,240 | B2 | 5/2020 | Reddy et al. | |
| 11,905,770 | B2 * | 2/2024 | Keast | E21B 3/022 |
| 2007/0251701 | A1 | 11/2007 | Jahn et al. | |

OTHER PUBLICATIONS https://venturetechnet.com/wp-content/uploads/XK-100-torque-reaction-drawing.jpg, website showing VentureTech Torque Reaction Rig-up, published (approx) Sep. 27, 2017.

* cited by examiner

*Primary Examiner* — James G Sayre
(74) *Attorney, Agent, or Firm* — Kearney, McWilliams & Davis, PLLC; John M. DeBoer

(57) ABSTRACT

A latch assembly having a first portion coupled with a second portion. The first portion has a roller housing, a latch panel, and handle, and the second portion has a respective roller housing, and a respective latch panel. In a closed position, the latch panel engages with the respective roller housing, and the respective latch panel engages with the roller housing.

18 Claims, 8 Drawing Sheets

LATCH ASSEMBLY FOR TORQUE MANAGEMENT

BACKGROUND

Field of the Disclosure

This disclosure generally relates to machines, tools, systems, and the like used in the oil and gas industry for torque management (e.g., restraint) of a drilling machine, such as a power swivel. More specifically, the disclosure relates to a latch assembly quick connect assembly for use in managing torque generated by operation of a power swivel. The latch assembly can be a quick connect assembly. The disclosure further pertains to a cable or wire rope quick connect assembly for torque reaction.

Background of the Disclosure

When drilling for oil or gas, a wellbore is typically drilled using a drill bit attached to the lower end of a "drill string." The process of drilling a well typically includes a series of drilling, tripping, casing and cementing, and repeating as necessary. The process of doing well servicing on a previously drilled, completed, and producing well uses many of the same operations although rotation is only required for operations such as milling out a packer and/or sometimes for drilling the well deeper.

Normally, relatively large drilling rigs are used for these wells, which utilize a 'kelly' table and associated equipment. Rigs of this sort take up an enormous amount of surface area and are typically capable of generating rotary torques of 35,000 foot-pounds (47,460 joules) or more.

FIG. 1A shows a simplified view of a conventional drilling operation 100 using a powerful driver. A derrick 102 (or drilling rig) is configured to rotate a drill string 104 that has a drill bit 106 disposed at a lower end of the drill string 104, typically using a driver unit 110 and associated equipment. The driver unit 110 rotates the string 104 and the drill bit 106 to do drilling or milling work downhole in the wellbore 108

Near the derrick 102, a plurality of tubular members 103*a* are often stored on a pipe rack(s) 112. The pipe rack 112 is relatively near the ground, and substantially below the rig floor 115. Therefore, tubulars 103, 103*a* must be transported to the rig floor 115 joint by joint for use in drilling or servicing operations.

Pipe handling systems are utilized to transport the tubular 103 from the pipe rack 112 and present the tubular 103 to rig floor 115 for use by rig floor personnel. Such pipe handling systems are commonly available from rental companies, well servicing or drilling companies, and the like. These systems are typically known as pipe handlers or hydraulic catwalks, which are operated to move the tubular(s) 103 from a horizontal position on the catwalk 113, up an inclined ramp or V-door 114, to the rig floor in the derrick 102 where rig floor personnel can latch on with an elevator and raise the pipe to a vertical position.

The derrick structures of these large drilling rigs require high capital and operating cost, including significant transport logistics. The rigs may be assembled on site and must be capable of withstanding rotary torques and other loads. As a result of size and strength, the derrick structure of these assembled drilling rigs need not require guy wire torsional or other support of these derrick structures.

For operations of less demand, and that do not require larger torques, a reduced-size and portable workover rig may be used. FIG. 1B shows a simplified view of a conventional drilling operation 100*a* that utilizes a workover rig 121.

The rig 121 may have mast 102*a* suitable for erecting onsite, thus avoiding the need for a large derrick that requires complete assembly. The mast 102*a* may have a first portion 101*a* and a second portion 102*b* that telescope together for easy transport.

The rig 121 is positioned, and the mast 102*a* is raised proximate the well/wellhead 122. Rotation is typically accomplished using driver, namely, a power swivel 110, thus eliminating the need for the kelly and associated equipment. To manage torque, torque reaction cables are used to mitigate torque loads generated by the power swivel, which is typically supported on a hook or travelling block 116. Resultant torque from operation is reacted through an arm of the power swivel 110 coupled with a wire line or torque cable that is tensioned on the rig between top or crown and bottom or rig floor. In this manner, the power swivel 110 can apply torque to a tubular (e.g., 103, FIG. 1A) while moving up or down the rig 102*a* with the pipestring.

Torques generated by the power swivel 110 are known to be limited, given the limited size of the rig 102*a*. For example, a torque limit of 2500 ft-lbs (3390 joules) is typical. Even with these torque limitations, there are unwanted safety risks, hardware damage risks, or other problems. To accommodate torque management, the power swivel 110 is configured with a torque arm bail pin, as well as a telescoping bar and tube. The end of the bar has historically been coupled with a torque reaction cable, such as via a shackle or hoop (with the cable passing therethrough.

The drawbacks of this configuration are numerous. For example, after continuous use the sliding friction between the shackle and (wire) cable can suffer integral damage, thus causing them to break, resulting in chance of injury to personnel and/or damage to equipment. Moreover, when torque is applied on the shackle, this results in sliding friction against the cable, which then increases stresses resulting in eventual cable failure/breaking. On top of rig floor, the shackle bolt needs to be removed to put over the wire. This results in a safety hazard if the bolt or shackle or tools are dropped on personnel below.

For a more elegant solution, torque arm rollers/pulleys/sheaves may be used which roll up and down the wire rope. FIG. 1C shows a conventional torque arm roller assembly 124 that may be coupled with a telescoping rod 123 movable within torque arm housing 122. The torque arm housing 122 may extend outward (such as laterally) from the power swivel 110. As the power swivel 110 moves up/down to with the pipe string, the torque arm roller assembly 124 follows along the torque guide cable 117 (via sheaves or rollers 118).

The use of the torque arm roller assembly 124, while useful for managing torque reaction, is cumbersome. Every time the rig 102*a* is erected, the roller assembly 124 must be disassembled and assembled in order to receive the cable 117 therein (or if lowered, remove the cable 117 therefrom).

A need exits for torque management that addresses these deficiencies and concerns. There is a need in the art for an assembly useful for torque management of a power swivel that may save time and increase safety. There is a need for rapid attachment and detachment. The ability to increase efficiency and save operational time and expense while increasing safety leads to considerable competition in the marketplace. Achieving any ability to save time, or ultimately cost, while increasing safety leads to an immediate competitive advantage.

SUMMARY

Embodiments of the present disclosure pertain to a latch assembly useful for torque management related to operation of a driver, such as a power swivel. The latch assembly may be configured for rapid or quick attachment/detachment.

Embodiments of the disclosure pertain to a latch assembly that may include a first portion coupled (such as movably) with a second portion. The first portion may include a first roller housing, a first latch panel, and a first handle. The first roller housing may include an at least one roller. The first roller housing may have a first side with a first latch receptacle and a first wing receptacle, and a second side with a first housing mount.

The first latch panel may be coupled with the first roller housing. The first latch panel may be configured with a first latch panel latch. The first handle may be coupled with the first latch panel. The first handle may be configured with a first handle wing configured to engage and/or disengage with the first wing receptacle.

The second portion may include a second roller housing. The second roller housing may have one or more rollers or sheaves. The second roller housing may have a respective first side, which may have a second latch receptacle and a second wing receptacle. There may be a respective second side with a second housing mount. There may be a second latch panel movably coupled with the second roller housing. The second latch panel may be configured with a second latch panel latch. There may be a second handle pivotably coupled with the second latch panel. The second handle may be configured with a second handle wing configured to engage and disengage with the second wing receptacle.

The latch assembly may have a first position. When in the first position, the first latch panel latch may be engaged with the second latch receptacle, and the second latch panel latch may be engaged with the first latch receptacle. The latch assembly may have a second position. In the second position, the first latch panel latch may be disengaged from the second latch receptacle, and the second latch panel latch may be disengaged from the first latch receptacle.

When the latch assembly is in the first position, the first handle wing may be engaged with the first wing receptacle and/or the second handle wing may be engaged with the second wing receptacle. When in the first position, a cable may be disposed through or otherwise engaged with the latch assembly. The cable may be moved therein via an operator.

In aspects, a driver such as a power swivel may be coupled with the latch assembly. The power swivel may have a torque arm housing configured with a telescoping rod. The telescoping rod may be configured with a telescoping rod end coupled with the latch assembly. There may be a hinge bolt disposed through each of the first roller housing, the second roller housing, and the telescoping rod end, thus forming a hinge or pivot point therebetween.

There may be a securing member disposed through each of the first roller housing and the at least one roller in a manner whereby the at least one roller remains rotatable around the securing member.

Embodiments herein may pertain to a torque management system. The system may be used for a drilling operation. There may be a rig having a top end and a bottom end. There may be a cable having a first cable end connected to the top end and a second cable end connected to the bottom end. There may be a power swivel operatively connected with the rig. There may be a latch assembly coupled with the power swivel. The latch assembly may be configured to have the cable engaged and disengaged therefrom. The latch assembly may include a first portion, and a second portion movably coupled with the first portion. When the latch assembly is in a first position, the first portion and the second portion may couple together in a manner whereby the cable is maintained therein. When the latch assembly is in a second position, the first portion and the second portion may be decoupled in a manner whereby the cable may be readily and freely removed from the latch assembly.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
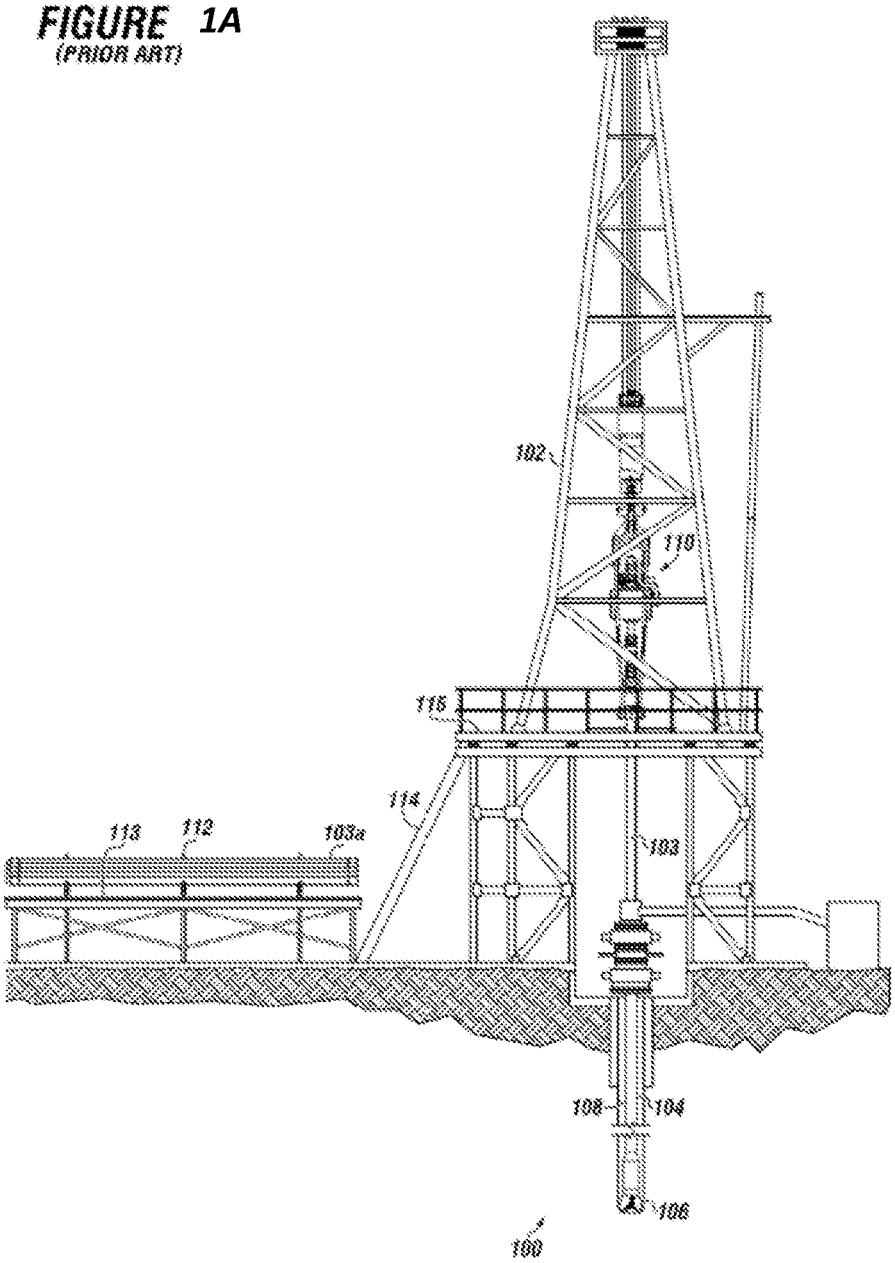
FIGURE 1A (PRIOR ART)
FIG. 1A is a side view of a process diagram of a conventional derrick operation for an oil and gas production system.
Figure 1C:
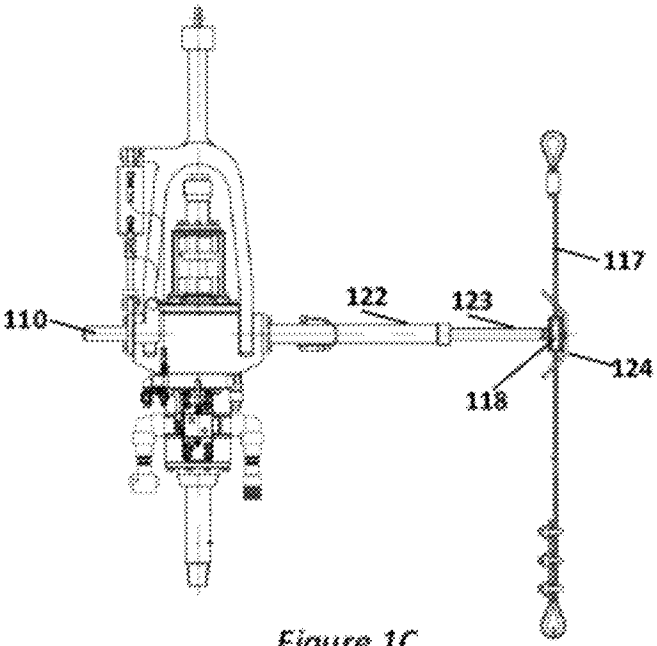
Figure 1C (PRIOR ART)
FIG. 1C is a side view of a process diagram of a conventional torque arm roller for a power swivel.
Figure 1B:
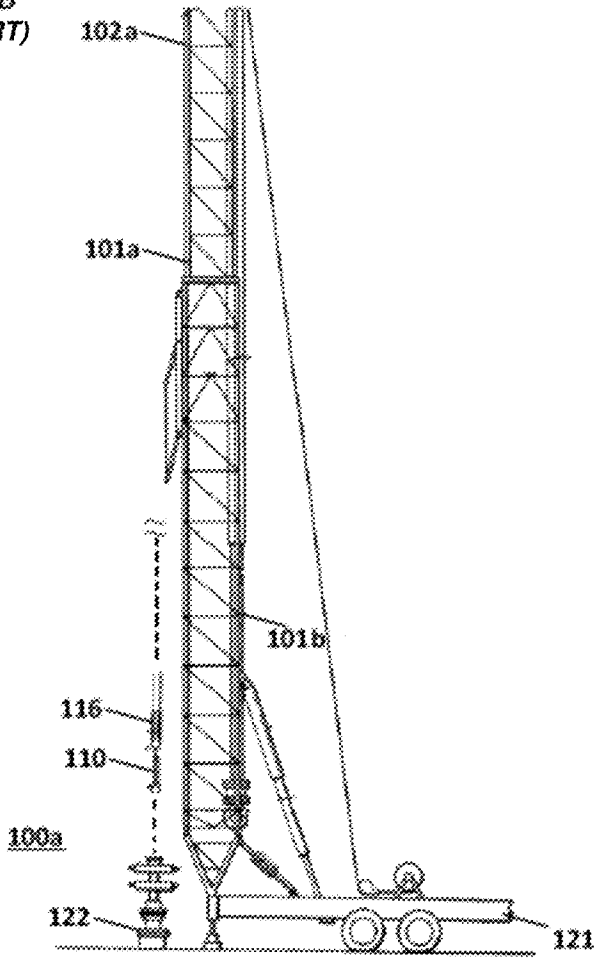
Figure 1B (PRIOR ART)
FIG. 1B is a side view of a process diagram of a conventional field-erected power swivel operation for an oil and gas production system.

Regardless of whether presently claimed herein or in another application related to or from this application, herein disclosed are novel apparatuses, units, systems, and methods that pertain to improved handling of tubulars, details of which are described herein. Such novel apparatuses may also have uses in applications unrelated to improved handling of tubulars, such as a latching assembly for engaging a pipe and allowing lateral movement. Additionally, slide components may be used instead of rollers.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, single phase, multi-phase, pure, impure, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may (but need not) be tubular in nature.

The term "composition" or "composition of matter" as used herein may refer to one or more ingredients, components, constituents, etc. that make up a material (or material of construction). Composition may refer to a flow stream of one or more chemical components.

The term "skid" as used herein may refer to one or more pieces of equipment operable together for a particular purpose. For example, a 'catwalk-power swivel skid' may refer to one or more pieces of equipment operable together to provide or facilitate presenting a tubular to a derrick. A skid may be mobile, portable, or fixed. Although 'skid' may refer to a modular arrangement of equipment, as used herein may be mentioned merely for a matter of brevity and simple reference, with no limitation meant. Thus, skid may be comparable or analogous to zone, system, subsystem, and so forth.

The term "skid mounted" as used herein may refer to one or more pieces operable together for a particular purpose that may be associated with a frame- or skid-type structure. Such a structure may be portable or fixed.

The term "engine" as used herein may refer to a machine with moving parts that converts power into motion, such as rotary motion. The engine may be powered by a source, such as internal combustion.

The term "motor" as used herein may be analogous to engine. The motor may be powered by a source, such as electricity, pneumatic, or hydraulic.

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' may further include reference to a driver, such as an engine and drive shaft. Types of pumps include gas powered, hydraulic, pneumatic, and electrical.

The term "utility fluid" as used herein may refer to a fluid used in connection with the operation of a heat generating device, such as a lubricant or water. The utility fluid may be for heating, cooling, lubricating, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "power swivel" as used herein may refer to a type of equipment used on a service rig or drilling rig, mainly to facilitate rotational operations. A power swivel may be powered, such as hydraulically or electrically, for handling or rotating tubulars, and may also act as a channel for drilling fluid. It also supports the weight of the drill string of pipe safely over men's heads. as used herein may refer to any driver machine or device suitable and known to one of ordinary skill in the art to impart work, typically in the form of suspending and rotating pipe. A power swivel or a top drive is an example of such a driver. A power swivel known to one of skill as being an alternative to and different from a rotary table.

The term "tubular handler" as used herein may refer to a mechanism, assembly, system, combination of equipment, and so forth for handling a pipe. For example, a tubular handler may have an elevator with an inclined ramp, and a chain drive skate mechanism designed to raise or lower a tubular.

Figure 2:
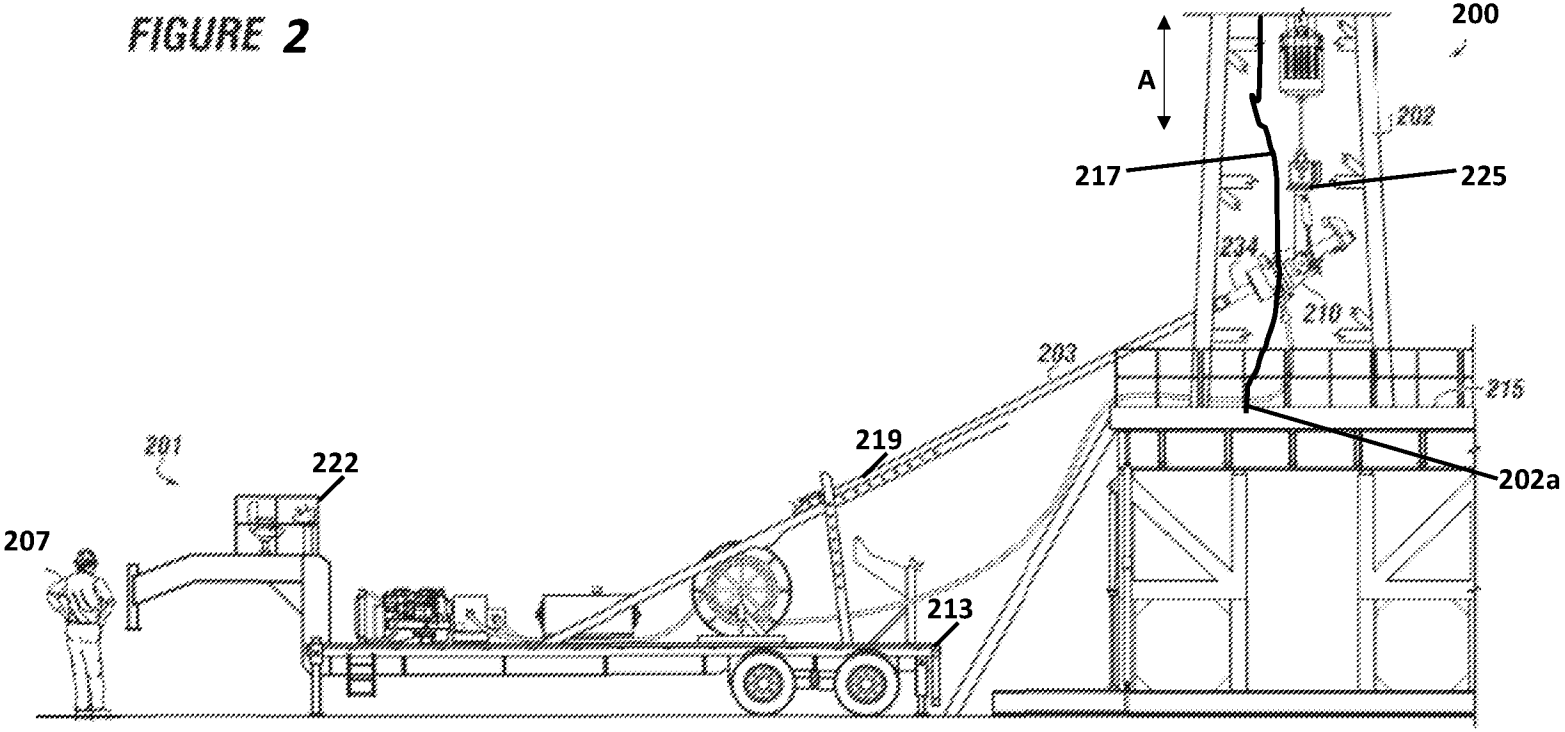
FIG. 2 shows a schematic side view of a drilling operation according to embodiments of the disclosure.

Referring now to FIG. 2, a schematic side view of a drilling operation, illustrative of embodiments disclosed herein, shown. Figure shows a drilling operation 200 that utilizes a mobile unit 201 that may be configured with a platform or other form of support structure 213 with various components attached thereon, including for transport. The platform 213 may be a trailer or a skid system configured to be towed or otherwise transported to a site for use. The mobile unit 201 may have a rig 202, which may be portable and field-erected. Just the same, the rig 202 may be assembled onsite, and is not otherwise limited to any size or configuration. Although shown as land-based, drilling operation 200 could be offshore, such that the mobile unit 201 could be a floating vessel.

While referred to as 'drilling', the working operation or system 200 is not meant to be limited, as there are a number of instances and operations where the unit 201 may be used. The unit 201 may be operated or otherwise used in a manner to provide, control, facilitate, etc. handling and transport of one or more components. In embodiments, the unit 201 may provide delivery of either a tubular 203 and/or a power swivel 210 to a rig or derrick 202. While it need not be exactly the same, the unit 201 may be assembled, run, and operated as described herein and in other embodiments, and as otherwise understood to one of skill in the art. Similarities may not be discussed for the sake of brevity.

Components of the unit 201 may be arranged by, disposed on, or otherwise coupled with a trailer or support frame 213, and as otherwise understood to one of skill in the art. Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the unit 201 for operation thereof. For example, a pump (with engine) may be in fluid communication with one or more sources, such as a fluid tank, with the unit 201 (or its components) being in fluid communication with a discharge of the pump (such as via a manifold, piping, tubing, etc.). All components of the unit 201 requiring power or automation may be provided with wiring, tubing, piping, etc. in order to be operable therefore.

The unit 201 may be used with and part of the system 200. As such, the system 200 may include the derrick 202 configured with suitable components to rotate a drill string. The drill string may be rotated with the power swivel type mechanism (with associated elevator, drive frame, draw-works, etc.).

The unit 201 may have a power swivel 210 and associated components. The power swivel 210 may be (movingly) located centrally or on one side of a center (axis) line of the rig 202. Associated or auxiliary components may include a hose reel, a hydraulic fluid tank, a pump and engine, and the like. In embodiments, a power swivel operator station 222 may be detachably secured to the platform 213. The power swivel operator station 222 may be placed adjacent a rig operator station (not shown here) to allow a rig personnel 207 to control the power swivel 210 and overall rig or system operation.

One of skill would appreciate that all operations associated with operating the unit 201, as well as operation of the power swivel 210 (including while on the rig 202), may be accomplished by personnel 207 via the operator station 222 and/or manually.

In embodiments, the unit 201 may have a pipe handler 219 for providing or removing tubulars 203 to the rig 202. When presented to the rig 202 (or rig floor 215), the tubular 203 may be engaged (e.g., threadingly) by the power swivel 210, lifted off the pipe handler 219, and then moved to a vertical position for engagement (making up) with another tubular (not shown here). The tubular 203 and/or power swivel 210 may be presented or otherwise positioned at an angle. The power swivel 210 may have a stem 234 for threadably engaging the tubular 203. The power swivel 210 may be operatively attached to a traveling block of the rig 202. The traveling block of the rig 202 may then be raise or lower the power swivel 210, as indicated by arrows A. Although the rig 202 is shown only in part here, one of skill would appreciate that the rig 202 may extend upward by hundreds of feet.

Referring now to FIGS. 3A, 3B, 3C, 3D, and 3E, a front view of a latch assembly, a side view of the latch assembly coupled with a power swivel, a lateral cross-sectional view of the latch assembly in a first or closed position, a lateral cross-sectional side view of the latch assembly in a second or open position, an isometric lateral cross-sectional side view of the latch assembly, and an isometric component breakout view of the latch assembly, respectively, illustrative of embodiments disclosed herein, are shown.

FIGS. 3A-3F together show a latch assembly 324 that may be used with a rig, derrick, or other comparable equipment. While referred to as a 'drilling operation' from time to time, embodiments herein are not limited and other applications are possible.

Figure 3B:
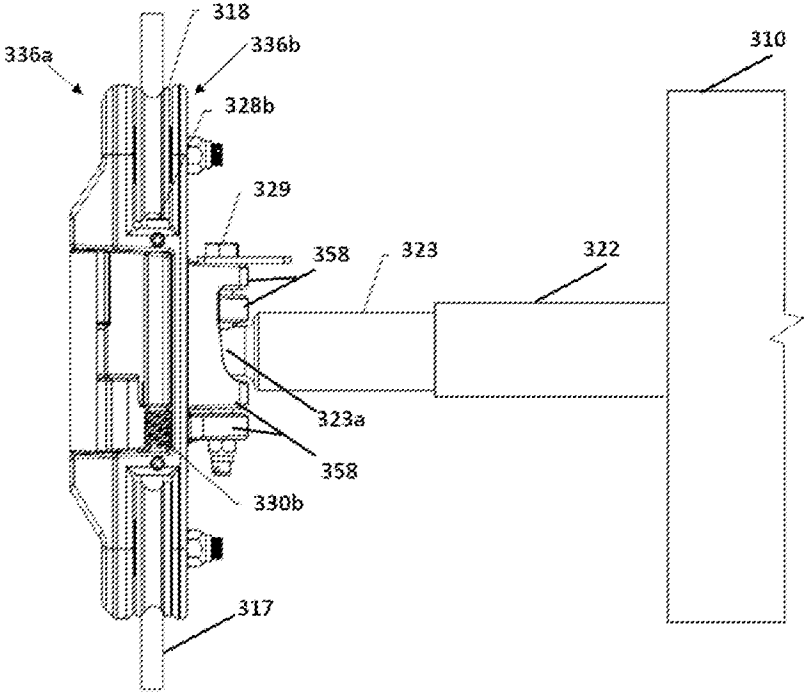
FIG. 3B shows a side view of the latch assembly of FIG. 3A coupled with a power swivel according to embodiments of the disclosure.
Figure 3A:
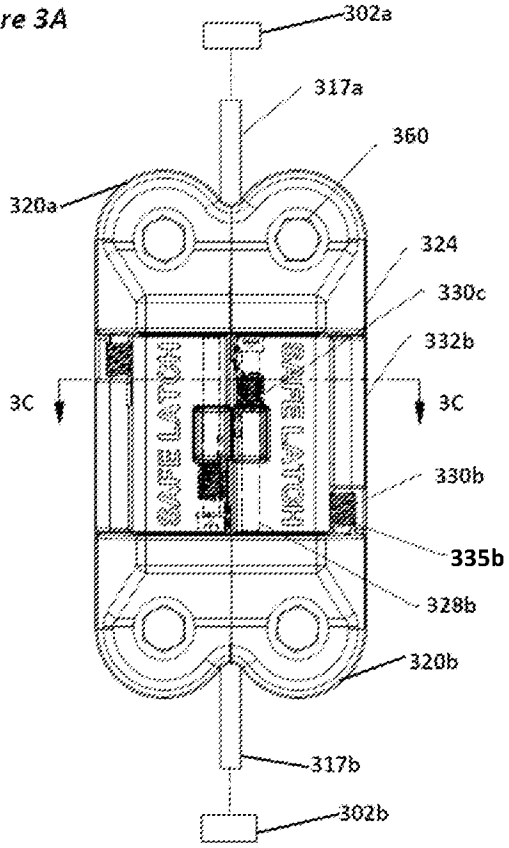
FIG. 3A shows a front view of a latch assembly according to embodiments of the disclosure.
Figure 3D:
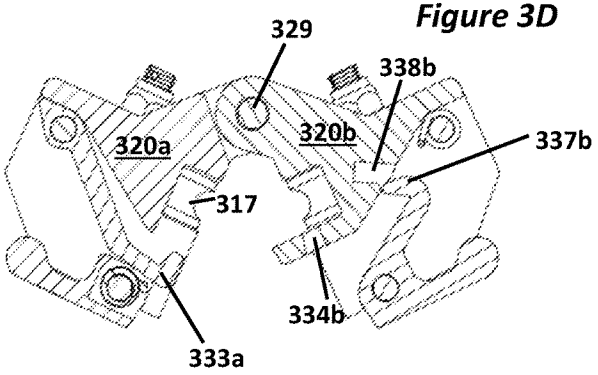
FIG. 3D shows a lateral cross-sectional side view of the latch assembly of FIG. 3A in a second or open position according to embodiments of the disclosure.
Figure 3E:
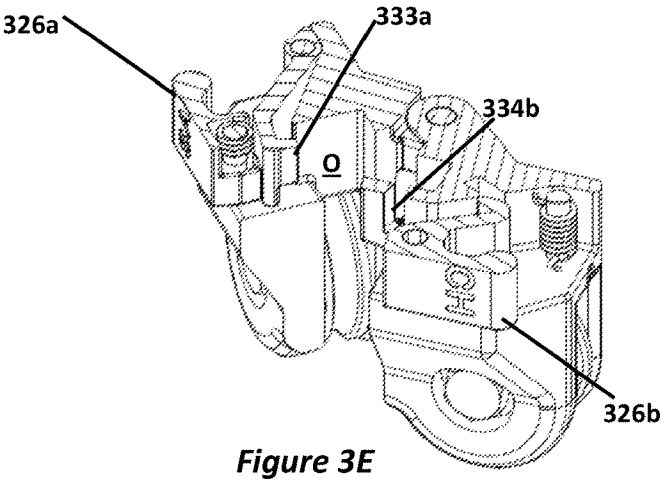
FIG. 3E shows an isometric lateral cross-sectional side view of the latch assembly of FIG. 3D according to embodiments of the disclosure.
Figure 3C:
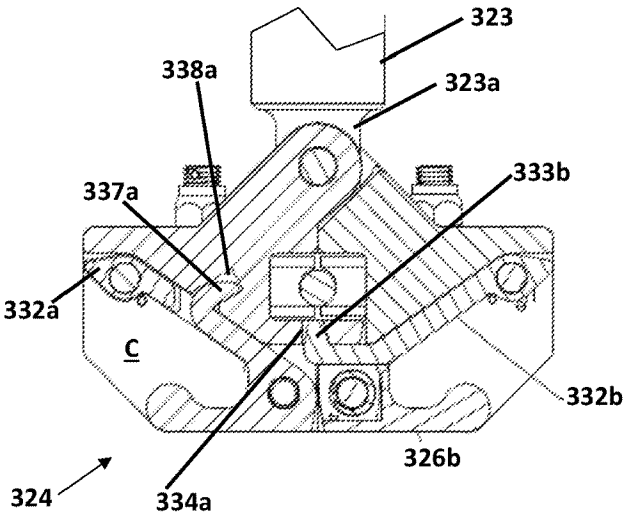
FIG. 3C shows a lateral cross-sectional view of the latch assembly of FIG. 3A in a first or closed position according to embodiments of the disclosure.
Figure 3F:
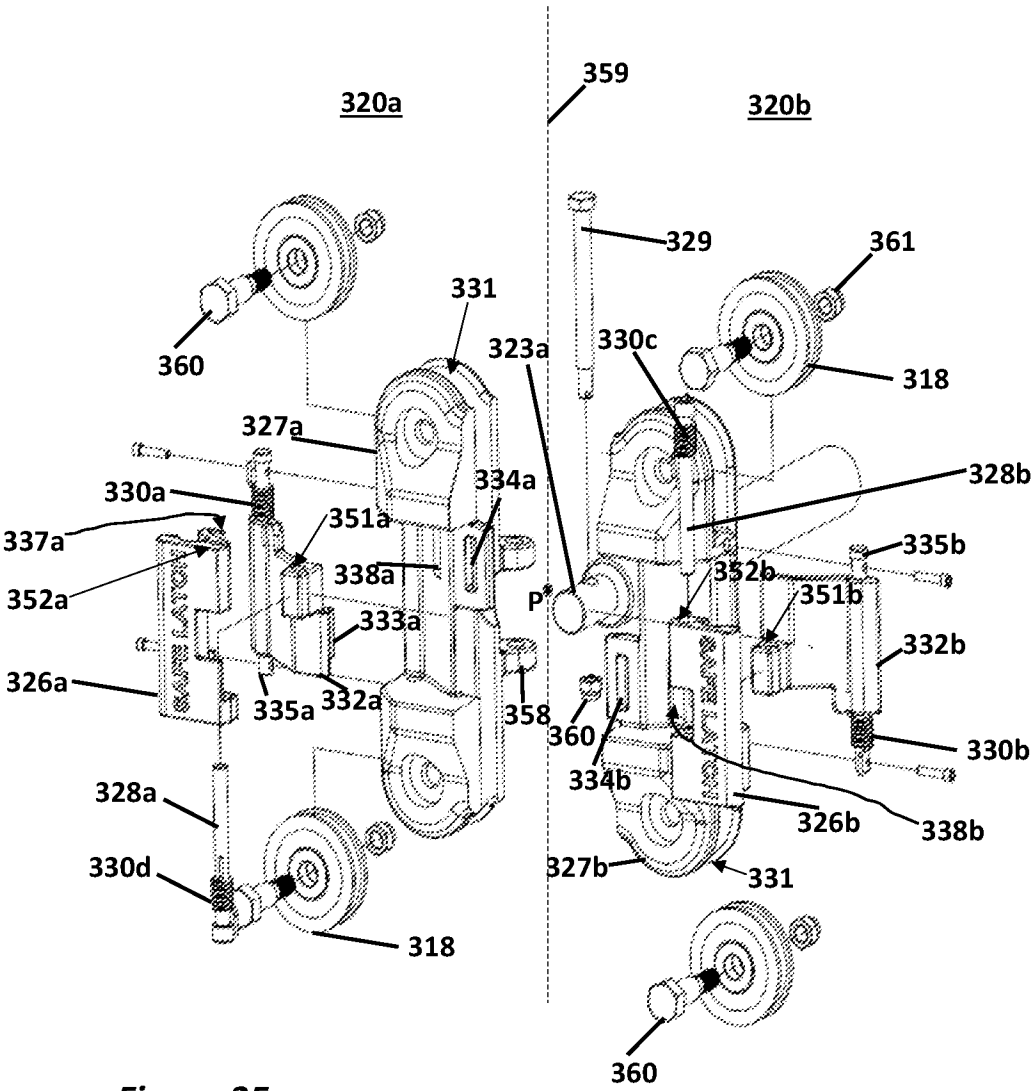
FIG. 3F shows an isometric component breakout view of the latch assembly of FIG. 3A according to embodiments of the disclosure.

The latch assembly 324 may have a first portion 320*a* and a second portion 320*b*. The portions 320*a* and 320*b* may be movably coupled together, such as via a hinge (see hinge bolt 329. FIGS. 3A, 3B, and 3C generally show the latch assembly 324 may be in a first or closed position 'C', whereas FIGS. 3D and 3E generally show the latch assembly 324 may be in or moved to a second or open position 'O'.

The ability to operation the latch assembly 324 to move from the first position to the second position, and vice versa, provides an operator with tremendous ease and flexibility to install/remove the guide assembly 324 around a cable 317. The cable 317 may extend along a derrick or rig (202, FIG. 2), such that a first or upper end 317*a* of the cable 317 may be coupled to a top end 302*a* of the rig, and a second or lower end 317*b* of the cable 317 may be coupled to a bottom end 302*b* of the rig.

The guide assembly 324 may have a frontward side 336*a* and a rearward side 336*b*. As shown here, the frontward side 336*a* may be accessible for opening and closing in order to put the cable 317 therein (and remove therefrom). The rearward side 336*b* may be configured for coupling to an adjacent piece of equipment, such as a power swivel 310. As one of skill in the art would appreciate, in operation of a high-powered driver, such as the power swivel 310, high amounts of torque are created. These forces can be detrimental to overall operation, and create an unsafe environment.

However, by coupling the power swivel 310 with the latch assembly 324, forces may be dissipated into the cable 317 and rig (202). As shown here, the power swivel may have a torque arm housing 322, which may be a rigid and durable 'arm' extension from the power swivel 310. The torque arm housing 322 may have a telescoping rod 323 movingly engaged therewith, as the ability for the rod 323 to have freedom of movement accounts for instabilities during drilling as the power swivel 310 is moved up and down. As the power swivel 310 is moved, the latch assembly 324 is able to correspondingly move along the cable 317.

Generally, the first portion 320*a* and the second portion 320*b* may be symmetrical to each other. For example, down a center line or axis 359, the pinwheel rotation of the second portion 320*b* around pivot point P to a right side up position results in the second portion 320*b* in this orientation being comparable to the first position 320*a*. The only difference may be the orientation of each respective portions housing mounts 358, which may be used to couple the assembly 324 with an end 323*a* of the telescoping rod 323. For example, the hinge bolt 329 may be disposed through one or more of the housing mounts of the first portion 320*a*, the mounts of the second portion 320*b*, and the rod end 323*a*.

As such, the first portion 320*a* has a similar configuration and makeup of subcomponents to that of the second portion 320*b*. For example, the first portion 320*a* has a first roller housing 327*a*, which may have its housing mounts 358 thereon. The roller housing 327*a* may be a generally rigid body suitable for one or more other components to be supported by or coupled therewith.

The first roller housing 327*a* may have one or more roller receptacles 331 configured for a respective roller or sheave 318 to be movably disposed therein. For example, there may be a locking member or bolt 360 disposed through an eye of the housing and of the roller, the bolt then held in place via nut 361 or other form securing. As one of skill would appreciate, the locking member 360 may have a suitable surface for which the roller is free to rotate around without significant friction impact.

The first roller housing 327*a* may have a first latch panel 332*a* coupled therewith. In embodiments, the first latch panel 332*a* may be movably coupled with the first roller housing 327*a*, such as hingedly. As shown here, there may be a first latch panel pin 335*a* disposed through respective holes or slots of the panel 332*a* and the housing 327*a*. To provide tension and better fit, there may be a bias member or spring 330*a* disposed around the pin 335*a*.

The first roller housing 327*a* may have a first handle 326*a* coupled therewith. In embodiments, the first handle 326*a* may be detachably coupled with the housing 327*a*. As shown here, the first handle 326*a* may be configured with a first handle wing 337*a* that may fit into a first wing slot 338*a* disposed in the housing 327*a*. The configuration of the first handle wing 337*a* may facilitate the ability to move the guide assembly 324 from the first position C to the second position O, and vice versa. It is worth nothing that when the assembly 324 is in any position other than the first position C, the wing 337*a* may be engaged or moved into engagement with the slot 338*a*.

The first handle 326*a* may also be coupled with the first latch panel 332*a*. In embodiments, the first latch panel 332*a* may be movably coupled with the first handle 326*a*, such as hingedly. As shown here, there may be a first handle pin 328*a* disposed holes or slots 351*a* and 352*a* of the first latch panel 332*a* and the first handle 326*a*, respectively. To provide tension and better fit, there may be a bias member or spring 330*d* disposed around the pin 328*a*.

The first latch panel 332*a* may be configured with a first latch 333*a* that engages a corresponding slot 334*b* of the second portion. The interlocking nature of the latches/slots may help keep the assembly 324 in the first position C, and avoid unintended opening.

The second portion 320*b* may be like that of the first portion 320*a*, it need not be the case and differences may exist. As shown here, the second portion 320*b* may have a second roller housing 327*b*, which may have its own housing mounts 358 thereon. The roller housing 327*b* may be a generally rigid body suitable for one or more other components to be supported by or coupled therewith.

The second roller housing 327*b* may have one or more roller receptacles 331 configured for a respective roller or sheave 318 to be movably disposed therein. For example, there may be a locking member or bolt 360 disposed through an eye of the housing and of the roller, the bolt then held in place via nut 361 or other form securing. As one of skill would appreciate, the locking member 360 may have a suitable surface for which the roller is free to rotate around without significant friction impact.

The second roller housing 327*b* may have a second latch panel 332*b* coupled therewith. In embodiments, the second latch panel 332*b* may be movably coupled with the second roller housing 327*b*, such as hingedly. As shown here, there may be a second latch panel pin 335*b* disposed through respective holes or slots of the panel 332*b* and the housing 327*b*. To provide tension and better fit, there may be a bias member or spring 330*b* disposed around the pin 335*b*.

The second roller housing 327*b* may have a second handle 326*b* coupled therewith. In embodiments, the second handle 326*b* may be detachably coupled with the housing 327*b*. As shown here, the second handle 326*b* may be configured with a second handle wing 337*b* that may fit into a second wing slot 338*b* disposed in the housing 327*b*. The configuration of the second handle wing 337*b* may facilitate the ability to move the guide assembly 324 from the first position C to the second position O, and vice versa. It is worth nothing that when the assembly 324 is in any position other than the first position C, the wing 337*b* may be engaged or moved into engagement with the slot 338*b*.

The second handle 326*b* may also be coupled with the second latch panel 332*b*. In embodiments, the second latch panel 332*b* may be movably coupled with the second handle 326*b*, such as hingedly. As shown here, there may be a second handle pin 328*b* disposed in holes or slots 351*b* and 352*b* of the second latch panel 332*b* and the second handle 326*b*, respectively. To provide tension and better fit, there may be a bias member or spring 330*c* disposed around the pin 328*b*.

The second latch panel 332*b* may be configured with a second latch 333*b* that engages a corresponding slot 334*a* of the first portion. The interlocking nature of the latches/slots may help keep the assembly 324 in the first position C, and avoid unintended opening.

Figure 4B:
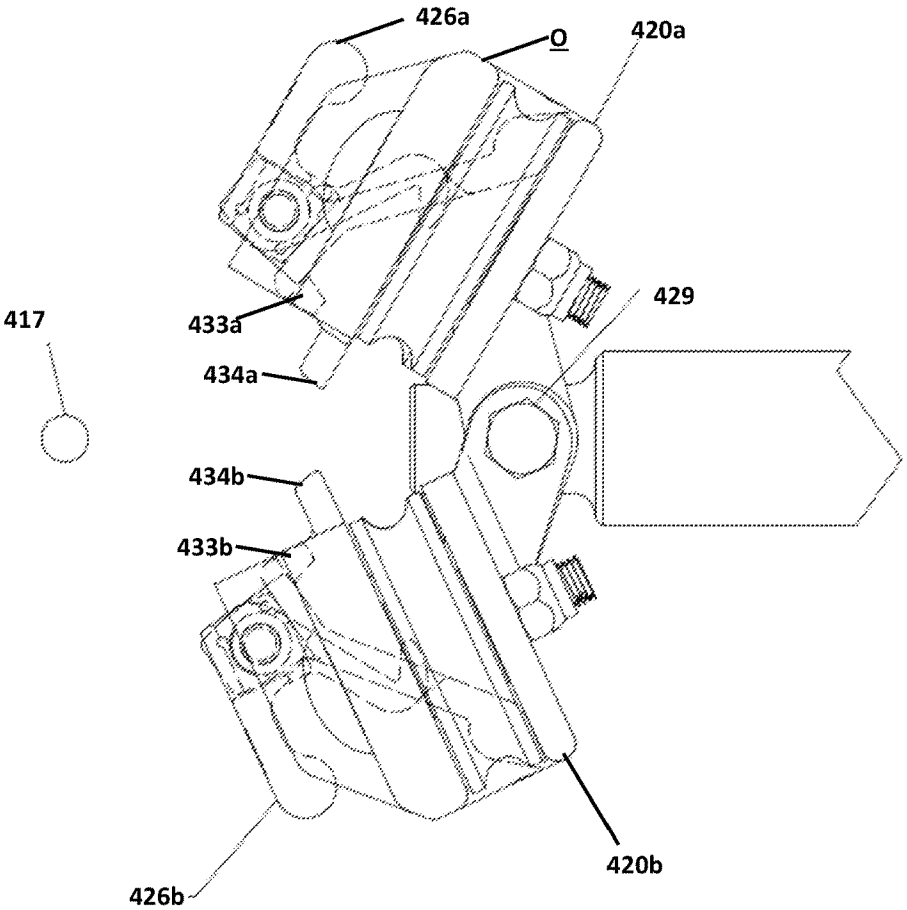
FIG. 4B shows a downward view of the latch assembly of FIG. 4A in an open position according to embodiments of the disclosure.
Figure 4A:
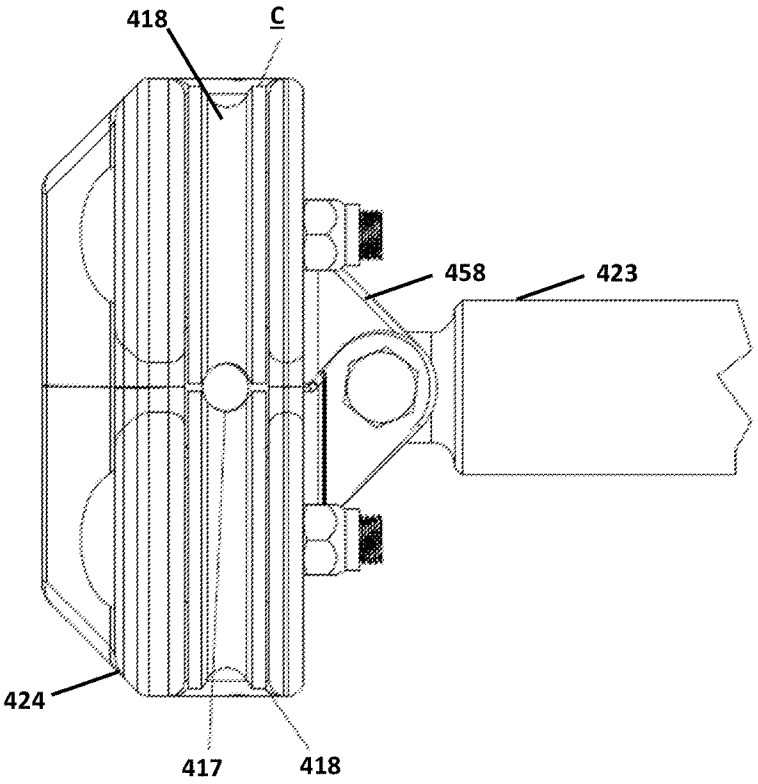
FIG. 4A shows a downward view of a latch assembly in a closed position according to embodiments of the disclosure.

Referring now to FIGS. 4A and 4B, a downward view of a latch assembly in a closed position and in an open position, illustrative of embodiments disclosed herein, are shown.

FIGS. 4A-4B together show a latch assembly 424 that may be used with a rig, derrick, or other comparable equipment, such as those mentioned with embodiments herein. The assembly 424 may like that of other assemblies described (e.g., 324, etc.), and similarities may not be discussed in detail. Just the same, there may be differences, including as described, if any.

The latch assembly 424 may have a first portion 420*a* and a second portion 420*b*. The portions 420*a* and 420*b* may be movably coupled together, such as via a hinge (see hinge bolt 429). The latch assembly 424 may be in a first or closed position 'C', or the latch assembly 424 may be in or moved to a second or open position 'O'.

The ability to operate the latch assembly 424 to move from the first position to the second position, and vice versa, provides an operator with tremendous ease and flexibility to install/remove the guide assembly 424 around a cable 417. The cable 417 may extend along a derrick or rig (202, FIG. 2).

The latch assembly 424 may be coupled with another piece of equipment, such as a power swivel (310) of the like. There may be a (telescoping) rod 423 movingly engaged with one or more housing mounts 458. The latch assembly 424 may be able to move up and down or otherwise along the cable 417 (via one or more rollers or sheaves 418).

To open the guide assembly 424, one or both of the handles 426*a*, 426*b* may be accessed, the movement thereof resulting in disengagement of latch 433*a* from latch slot 434*b*, and/or disengagement of latch 433*b* from latch slot 434*a*. Once disengaged, the portions 420*a*, 420*b* may be opened the cable 417 removed or inserted. To move the C position, the handles 426*a*, 426*b* are moved in a manner that allows the respective latches and slots to (re)engage. The interlocking nature of the latches/slots may help keep the assembly 424 in the first position C, and avoid unintended opening.

Referring now to FIGS. 4A and 4B, a downward view and a side profile view, respectively, of a latch assembly in a locked position, illustrative of embodiments disclosed herein, are shown.

Figure 5B:
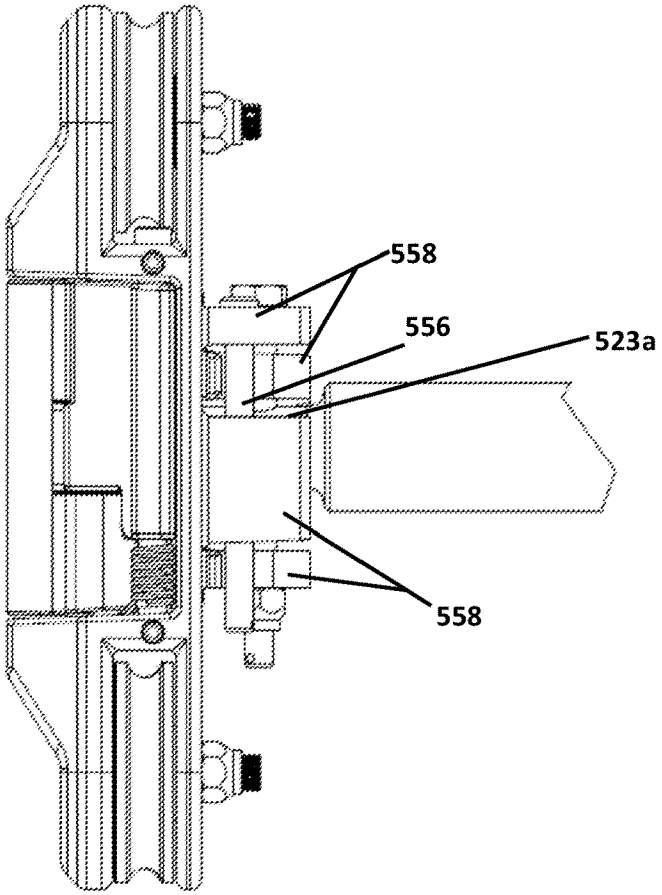
FIG. 5B shows a side profile view of the latch assembly of FIG. 5B in a closed position according to embodiments of the disclosure.
Figure 5A:
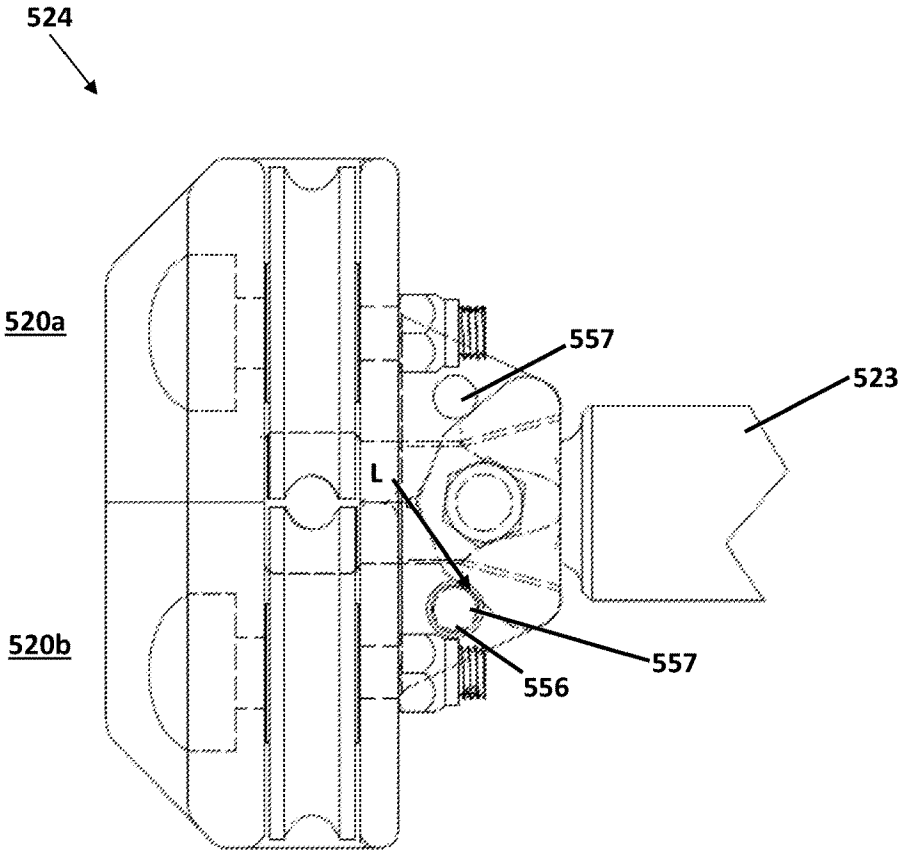
FIG. 5A shows a downward view of a latch assembly in a locked position according to embodiments of the disclosure.

FIGS. 5A-5B together show a latch assembly 524 that may be used with a rig, derrick, or other comparable equipment, such as those mentioned with embodiments herein. The assembly 524 may like that of other assemblies described (e.g., 324, etc.), and similarities may not be discussed in detail. Just the same, there may be differences, including as described, if any.

The latch assembly 524 may have a first portion 520*a* and a second portion 520*b*. The portions 520*a* and 520*b* may be movably coupled together, such as via a hinge. The latch assembly 524 may be in a first or closed position, or the latch assembly 524 may be in or moved to a second or open position.

The latch assembly 524 may be coupled with another piece of equipment, such as a power swivel (310) or the like. There may be a (telescoping) rod 523 (via rod end 523*a*) movingly engaged with one or more housing mounts 558. The interlocking nature of the portions 520*a*, 520*b* may help keep the assembly 524 in the first or closed position. Moreover, the portions 520*a*, 520*b* may be configured with respective lock pin slots or holes 557, for which then a lock pin 556 may be inserted therein. The proximity of the lock pin 556 to the mounts results in a contact point L that keeps the portions 520*a*, 520*b* 'locked' or otherwise closed together. Only upon removal of the pin 556 may the assembly 524 be moved to the second or open position.

Advantages

Embodiments of a latch assembly of the present disclosure may accommodate rapid latch and unlatch from cables, ropes, etc. There are no tools, lost parts, or falling objects. This means that no-lube roller sheaves may stay in place. A simple pull on the handle(s) may provide an unlock and unlatch. Just open, move the cable therein, and close.

Embodiments of the disclosure pertain to use of rollers or sheaves configured to traverse a guide cable. The rollers need not be metal, which eliminates metal to metal contact and allows power swivel or driver assembly to travel smoothly. When power swivel is in operation, the torque created applies load to the rollers, which distributes load against guide cable. Embodiments herein advantageously require no bolts to be removed; instead, just operation of handles to quickly connect or disconnect from wire rope.

Embodiments herein may be retrofitted to existing field equipment. Companies who have purchased a power swivel may retrofit embodiments of the disclosure described herein to put on their assembly.

Embodiments herein may be used to install power swivel quickly and safely without the need to unbolt anything, and may further allow power swivel to traverse the guide cable smoothly and to stabilize the power swivel while under operation.

Safety: the need to disassemble and reassemble loose parts (especially at high elevation) may be mitigated or eliminated. Provides a rigid system resistant to fail/break as a result of cable friction.

Reliability: embodiments herein may last longer and preforms better than other conventional torque reaction systems.

Speed: time needed to install on cable may be reduced.

Even a small savings in drilling or servicing time of individual wells results in an enormous savings on an annual basis.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A latch assembly comprising:

a first portion, the first portion further comprising:

a first roller housing configured with an at least one roller, the first roller housing having a first side with a first latch receptacle and a first wing receptacle, and a second side with a first housing mount;

a first latch panel coupled with the first roller housing, the first latch panel configured with a first latch panel latch;

a first handle coupled with the first latch panel, the first handle configured with a first handle wing configured to engage and disengage with the first wing receptacle; and a second portion movably coupled with the first portion, the second portion further comprising:

a second roller housing configured with another roller, the second roller housing having a respective first side with a second latch receptacle and a second wing receptacle, and a respective second side with a second housing mount;

a second latch panel, wherein when the latch assembly is in a first position, the first latch panel latch is engaged with the second latch receptacle.

2. The latch assembly of claim 1, wherein the second portion further comprises:

a second handle coupled with the second latch panel, the second handle configured with a second handle wing configured to engage and disengage with the second wing receptacle, wherein the second latch panel is coupled with the second roller housing, and wherein the second latch panel is configured with a second latch panel latch.

3. The latch assembly of claim 2, wherein in the first position the second latch panel latch is engaged with the first latch receptacle.

4. The latch assembly of claim 3, wherein when the latch assembly is in a second position, the first latch panel latch is disengaged from the second latch receptacle, and the second latch panel latch is disengaged from the first latch receptacle.

5. The latch assembly of claim 3, wherein when the latch assembly is in the first position, the first handle wing is engaged with the first wing receptacle, and the second handle wing is engaged with the second wing receptacle.

6. The latch assembly of claim 1, wherein in the first position, a cable is disposed through the latch assembly.

7. The latch assembly of claim 6, wherein a power swivel is coupled with the latch assembly.

8. The latch assembly of claim 6, wherein a torque arm housing is configured with a telescoping rod, and the telescoping rod is configured with a telescoping rod end coupled with the latch assembly.

9. The latch assembly of claim 8, wherein a hinge bolt is disposed through each of the first roller housing, the second roller housing, and the telescoping rod end.

10. The latch assembly of claim 1, wherein the first roller housing further comprises a first roller receptacle with the at least one roller disposed therein, and wherein a securing member is disposed through each of the first roller housing and the at least one roller in a manner whereby the at least one roller remains rotatable around the securing member.

11. The latch assembly of claim 1, wherein a lock pin is disposed through at least one of: the first roller housing, the second roller housing, and combinations thereof, and wherein the latch assembly is maintained in the first position by the presence of the lock pin, and wherein the latch assembly is movable to a second position when the lock pin is removed.

12. A torque management system comprising:

a rig having a top end and a bottom end;

a cable having a first cable end connected to the top end and a second cable end connected to the bottom end;

a power swivel comprising a torque arm housing configured with a telescoping rod; and a latch assembly configured to have the cable engaged and disengaged therefrom, and further comprising:

a first portion; and a second portion movably coupled with the first portion, wherein when the latch assembly is in a first position, the first portion and the second portion couple together in a manner whereby the cable is maintained therein, wherein when the latch assembly is in a second position, the first portion and the second portion are decoupled in a manner whereby the cable is able to be removed from the latch assembly, and wherein the telescoping rod is configured with a telescoping rod end coupled with the latch assembly.

13. The torque management system of claim 12, wherein the first portion further comprises:

a first roller housing configured with an at least one roller, the first roller housing having a first side with a first latch receptacle and a first wing receptacle, and a second side with a first housing mount;

a first latch panel coupled with the first roller housing, the first latch panel configured with a first latch panel latch; and a first handle coupled with the first latch panel, the first handle configured with a first handle wing configured to engage and disengage with the first wing receptacle.

14. The torque management system of claim 13, wherein the first roller housing further comprises a first roller receptacle with the at least one roller disposed therein, and wherein a securing member is disposed through each of the first roller housing and the at least one roller in a manner whereby the at least one roller remains rotatable around the securing member.

15. The torque management system of claim 13, wherein the second portion further comprises:

a second roller housing configured with another roller, the second roller housing having a respective first side with a second latch receptacle and a second wing receptacle, and a respective second side with a second housing mount;

a second latch panel pivotably coupled with the second roller housing, the second latch panel configured with a second latch panel latch; and a second handle pivotably coupled with the second latch panel, the second handle configured with a second handle wing configured to engage and disengage with the second wing receptacle.

16. A latch assembly comprising:

a first portion, the first portion further comprising:

a first roller housing having a first side with a first latch receptacle and a first wing receptacle, and a second side with a first housing mount;

a first latch panel pivotably coupled with the first roller housing, the first latch panel configured with a first latch panel latch;

a first handle pivotably coupled with the first latch panel, the first handle configured with a first handle wing configured to engage and disengage with the first wing receptacle; and a second portion coupled with the first portion, the second portion further comprising:

a second roller housing having a respective first side with a second latch receptacle and a second wing receptacle, and a respective second side with a second housing mount; and a second latch panel, wherein when the latch assembly is in a first position, the first latch panel latch is engaged with the second latch receptacle, and the second latch panel latch is engaged with the first latch receptacle.

17. The latch assembly of claim 16, wherein when the latch assembly is in a second position, the first latch panel latch is disengaged from the second latch receptacle, and the second latch panel latch is disengaged from the first latch receptacle.

18. The latch assembly of claim 17, wherein the first roller housing further comprises a first roller receptacle with the at least one roller disposed therein, and wherein a securing member is disposed through each of the first roller housing and the at least one roller in a manner whereby the at least one roller remains rotatable around the securing member.

* * * * *